US007360496B2

(12) United States Patent
Niizeki

(10) Patent No.: US 7,360,496 B2
(45) Date of Patent: Apr. 22, 2008

(54) WORKPIECE CLOTH RULER SUITABLE FOR USE WITH SEWING MACHINE

(75) Inventor: Tomoyasu Niizeki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/709,145

(22) Filed: Feb. 22, 2007

(65) Prior Publication Data

US 2007/0215025 A1 Sep. 20, 2007

(30) Foreign Application Priority Data

Mar. 15, 2006 (JP) ..... 2006-070313

(51) Int. Cl.
*D05B 35/10* (2006.01)
*D05B 27/00* (2006.01)

(52) U.S. Cl. ..... 112/153; 112/240

(58) Field of Classification Search ..... 112/136, 112/153, 151, 235, 240, 306
See application file for complete search history.

(56) References Cited

U.S. PATENT DOCUMENTS 1,087,216 A * 2/1914 Cooper ..... 112/136
1,547,965 A * 7/1925 Seybert ..... 112/153
2,094,918 A * 10/1937 Greist et al. ..... 112/139
2,478,032 A * 8/1949 Wallsh ..... 112/151
2,645,194 A * 7/1953 Underwood ..... 112/153

FOREIGN PATENT DOCUMENTS

| | | |
|---|---|---|
| JP | Y 53-52500 | 12/1978 |
| JP | Y2 59-25350 | 7/1984 |
| JP | Y2 62-4308 | 1/1987 |
| JP | U-02-4573 | 1/1990 |
| JP | U 5-70477 | 9/1993 |
| JP | A 8-173662 | 7/1996 |
| JP | B2 2876809 | 1/1999 |
| JP | A 2005-7194 | 1/2005 |

* cited by examiner

*Primary Examiner*—Ismael Izaguirre
(74) *Attorney, Agent, or Firm*—Oliff & Berridge, PLC

(57) ABSTRACT

A workpiece cloth ruler is disclosed which is detachably attachable to an attaching part of a cloth presser holder or a walking foot to which a cloth presser is attached to press workpiece cloth. The ruler includes a bar-shaped support detachably attachable to the attaching part of the cloth presser holder so as to be directed in a right-left direction and so as to be substantially horizontal, a connecting part located on an end of the bar-shaped support, a cloth guide pivotally non-releasably attached via a supporting part to the connecting part of the bar-shaped support so as to be vertically pivotable, and an elastic member biasing the cloth guide to the workpiece cloth side so that the cloth guide pivots.

8 Claims, 8 Drawing Sheets

WORKPIECE CLOTH RULER SUITABLE FOR USE WITH SEWING MACHINE

CROSS-REFERENCE TO RELATED APPLICATIONS

This application is based upon and claims the benefit of priority from the prior Japanese Patent Application No. 2006-70313 filed on Mar. 15, 2006, the entire contents of which are incorporated herein by reference.

BACKGROUND

1. Technical Field

The present disclosure relates to a workpiece cloth ruler detachably attachable to an attaching part of a cloth presser holder or a walking foot so that workpiece cloth such as quilting cloth is sewn while a stitch line interval is held constant.

2. Description of the Related Art

Quilting rulers (workpiece cloth rulers) are generally used when stitches are sewn so as to be spaced away from a previous stitch line in the case where quilting stitches are carried out in which, for example, stitches are formed lengthwise and crosswise on quilting cloth. A quilting ruler is detachably attached to an attached part of a cloth presser holder or a walking foot attached to a lower end of a presser bar, as occasion arises. Various types of quilting rulers have been proposed and put into practical use. For example, JP-Y-S53-52500 (first reference) discloses a ruler bar holder in which a recess is formed in an upper part of a rear support of a presser holder. A ruler bar includes a horizontal part fitted in the recess so as to be pressed against the recess by a leaf spring. In this construction, the horizontal part of the ruler bar has a section formed into the shape of a drum. The leaf spring has a free end which is usually pressed against a flat surface of the drum-shaped horizontal part, whereupon the ruler bar is retained at a predetermined position with respect to a horizontal direction thereof.

Furthermore, JP-U1-H05-70477 (second reference) discloses a ruler bar holder comprising a cover having two opposed walls formed with respective U-shaped grooves. Each groove has one end which is open outwards. The ruler bar bent into an L-shape has a shaft having a circular section and thrust into a recess of the U-shaped groove of the cover, whereby the ruler bar is retained between the recess and protrusion.

In the ruler bar holder disclosed in the first reference, the horizontal part of the ruler bar having the section formed into the drum-shape is pressed against the recess of the rear support by the spring force of the leaf spring. Furthermore, in the ruler bar holder disclosed by the second reference, the ruler bar is adapted to be retained at a predetermined initially mounted position by the holding force of the recess of each U-shaped groove. Accordingly, particularly when quilting cloth is to be sewn, the ruler bar of each above-noted reference passes an upwardly corrugated swollen part of the surface of the quilting cloth and is thereafter held in an upwardly lifted state. More specifically, when once lifted up, the ruler bar is not lowered by the self-weight but held in the lifted state since the spring force of the leaf spring or the holding force is strong. Since the ruler bar is not effective as a gauge in this state, the operator needs to lower the ruler bar manually so that the ruler bar contacts the surface of the quilting cloth, whereupon the working efficiency in quilting is lowered.

In view of the aforesaid problem, it is considered that an upwardly elastically deformable spring steel or spring wire is used to constitute a one-end guide located at one side of the presser foot in the ruler bar or a forward directed ruling part of the ruler bar. However, when the guide or ruling part is made of spring steel, the thickness of the spring steel needs to be increased so as to be prevented from plastic deformation even in subjection to an unexpected external force. Furthermore, the width of the spring steel needs to be increased so that a suitable strength is obtained. When the guide or ruling part is made of spring wire, wire diameter needs to be increased so that a suitable strength is achieved. As a result, the spring constant is increased and accordingly, an amount of change in the spring force is increased relative to the flexible volume of the spring. Particularly in quilting, the ruler bar cannot be moved smoothly along the corrugated surface of the quilting cloth.

SUMMARY

Therefore, an object of the present disclosure is to provide a workpiece cloth ruler which has a small size and a simple mechanism and can follow the surface of workpiece cloth such as corrugated surface of quilting cloth.

The present disclosure provides a workpiece cloth ruler which is detachably attachable to an attaching part of a cloth presser holder or a walking foot to which a cloth presser is attached to press workpiece cloth, the ruler comprises a bar-shaped support detachably attachable to the attaching part of the cloth presser holder so as to be directed in a right-left direction and so as to be substantially horizontal, the bar-shaped support having an end, a connecting part provided on the end of the bar-shaped support, a cloth guide which is pivotally non-releasably attached via a supporting part to the connecting part of the bar-shaped support so as to be vertically pivotable, and an elastic member biasing the cloth guide to the workpiece cloth side so that the cloth guide pivots.

The above-described workpiece cloth ruler is detachably attachable to the attaching part of the cloth presser holder or the walking foot to which the cloth presser is attached to press the workpiece cloth. In this construction, the ruler comprises the bar-shaped support, the connection, the cloth guide and the elastic member. When a swollen part of the workpiece cloth is to be sewn during a sewing operation, the cloth guide is temporally swung upward but returned downward after having passed along the protuberant part of the workpiece cloth, thereby being swung so that the cloth guide continuously follows up the surface of the workpiece cloth. Since the operator need not lower the cloth guide to the surface of the workpiece cloth manually every time the cloth guide passes along the protuberant part, the working efficiency in the sewing operation can remarkably be improved.

BRIEF DESCRIPTION OF THE DRAWINGS

Other objects, features and advantages of the present disclosure will become clear upon reviewing the following description of the illustrative example with reference to the accompanying drawings, in which.

DETAILED DESCRIPTION OF THE DISCLOSURE

An embodiment of the present disclosure will be described with reference to FIGS. 1 to 10. In the illustrative example, the disclosure is applied to a quilting ruler. Firstly, a walking foot 1 to which a quilting ruler 10 is detachably attached before the quilting ruler 10 is described.

Figure 1:
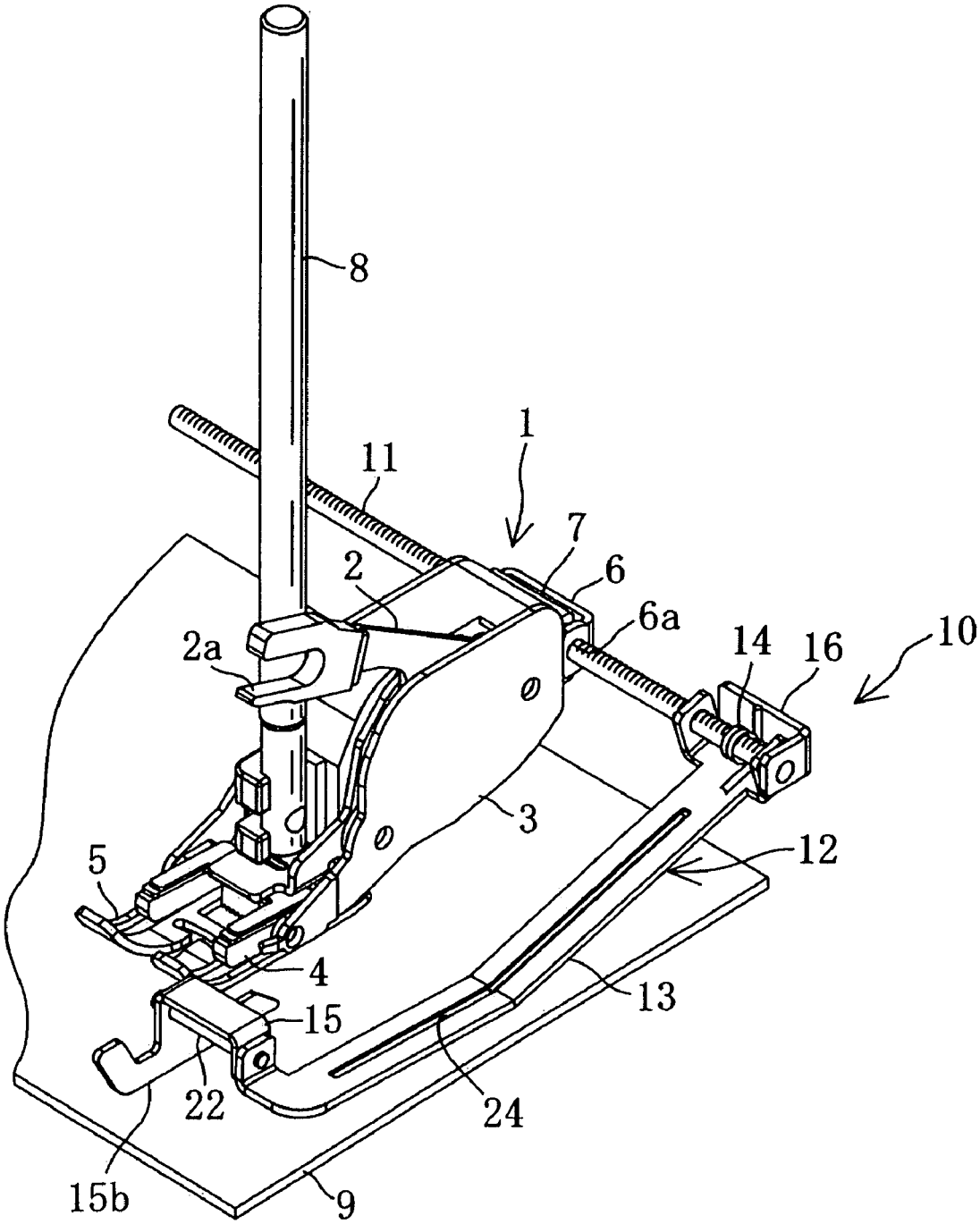
FIG. 1 is a perspective view of a quilting ruler of a first illustrative example in accordance with the present disclosure, the quilting ruler being attached to an attaching part of a walking foot.
Figure 5:
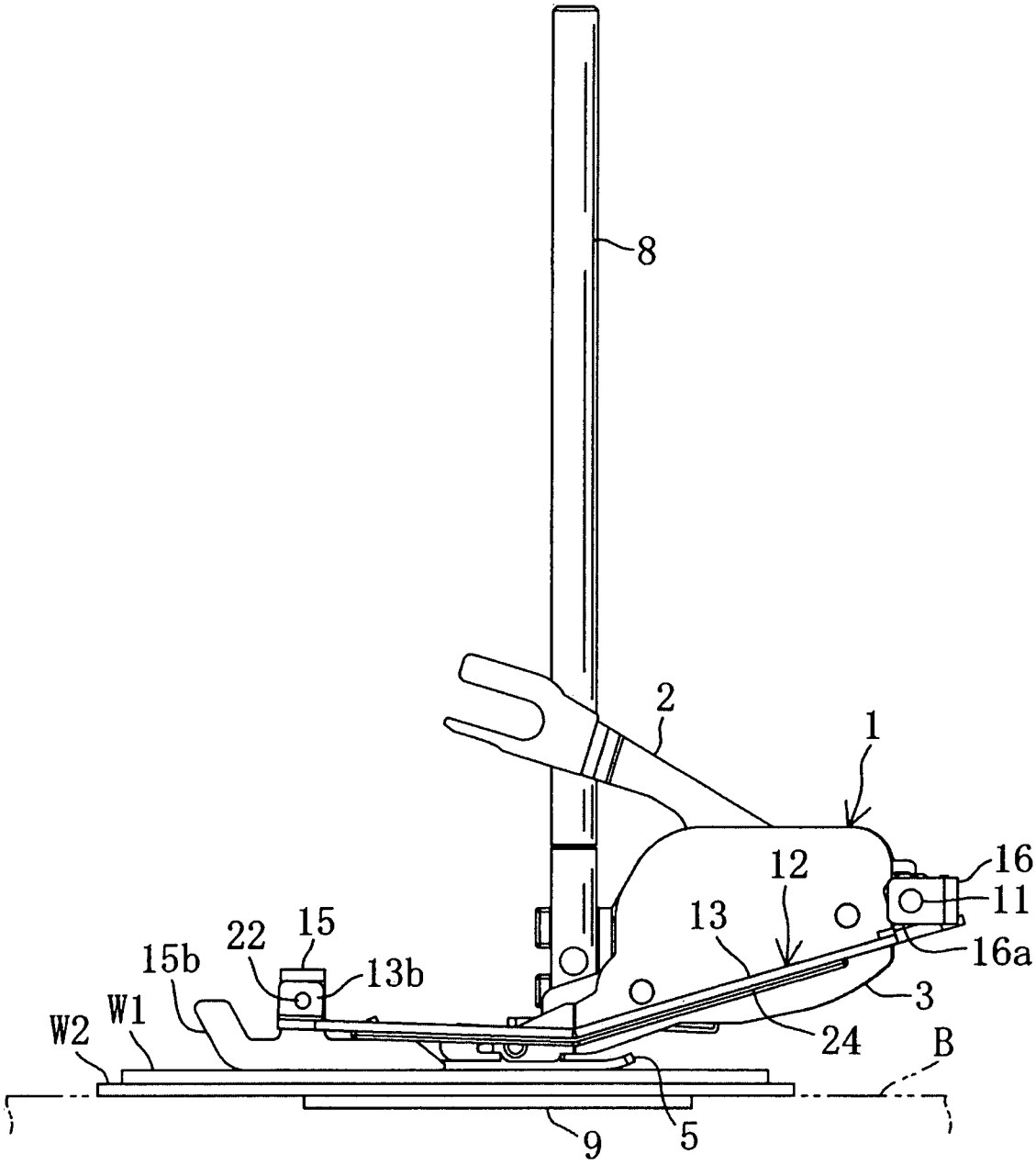
FIG. 5 is a right side view of the quilting ruler attached to the attaching part of the walking foot.
Figure 6:
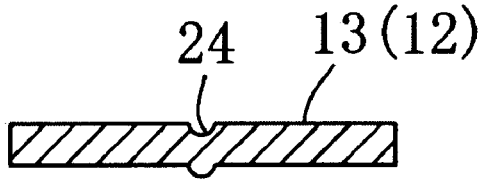
FIG. 6 is a longitudinally sectional front view taken along line VI-VI in FIG. 2.
Figure 9:
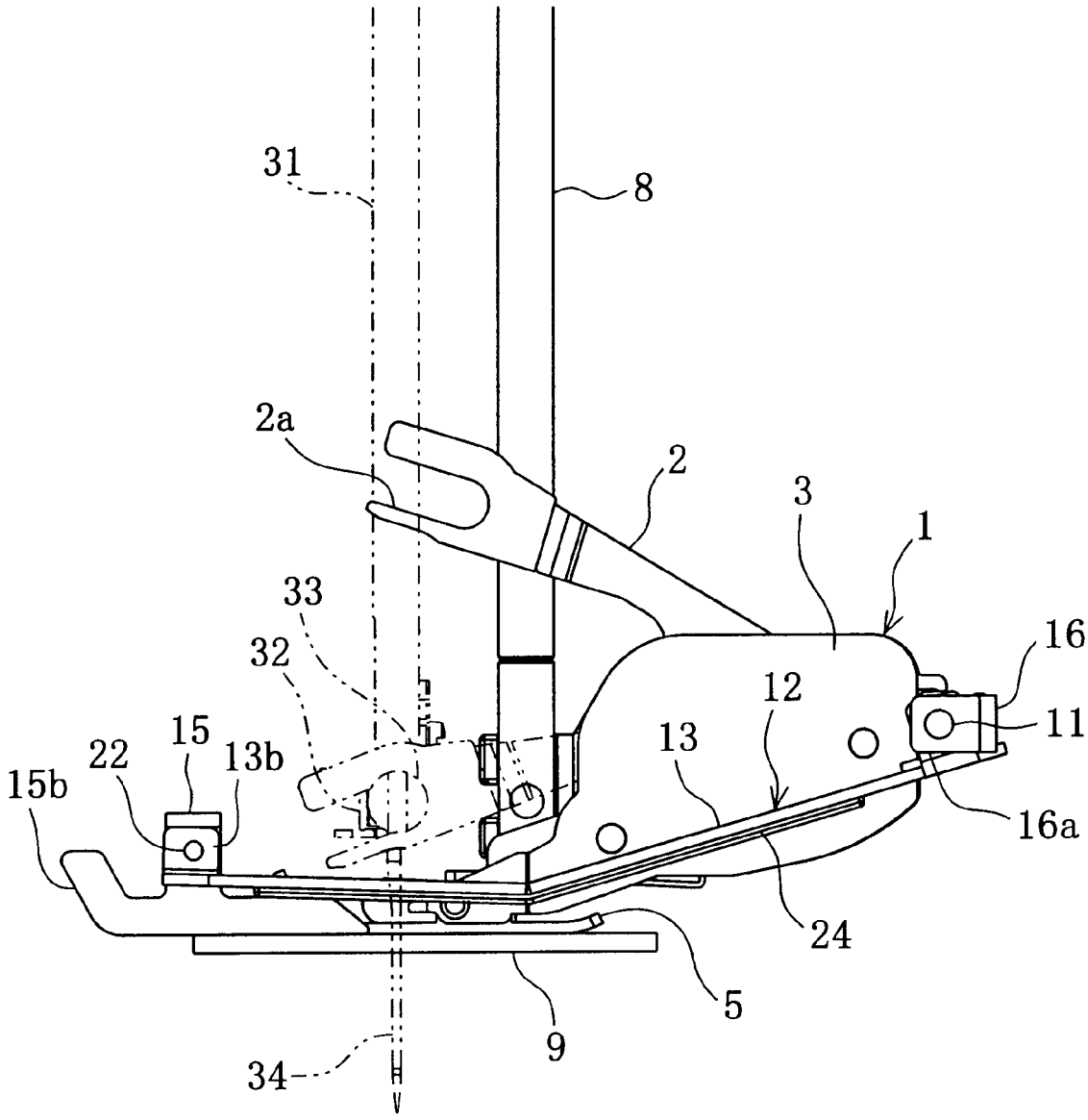
FIG. 9 is a view similar to FIG. 5, showing a needle bar and a sewing needle.
Figure 10:
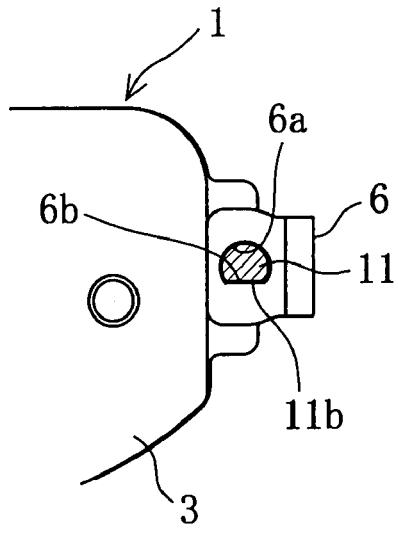
FIG. 10 is a longitudinally sectional side view of the attaching part and a bar-shaped support.

Referring to FIGS. 1, 5 and 9, the walking foot 1 includes a swing lever 2, a body frame 3, a transmission lever (not shown), a feed presser 4, a feed presser 4, a cloth presser 5 and the like. The swing lever 2 has a bifurcated part 2*a* coupled to a shaft 33 of a needle bar connecting stud 32 secured to a needle bar 31 (see two-dot chain line in FIG. 9). A sewing needle 34 is mounted on the needle bar connecting stud 32. The swing lever 2 has a proximal end which is supported on the body frame 3 so as to be swingable.

The body frame 3 is secured to a lower end of a presser bar 8 by a setscrew (not shown). The transmission lever is supported by the body frame 3 sp as to be swingable. The feed presser 4 is pressed downward by a distal end of the transmission lever. However, the feed presser 4 is biased upward by a spring member (not shown). Furthermore, a cloth presser 25 is supported on a distal end of the body frame 3.

When the needle bar 31 is vertically moved upon start of a sewing operation in the above-described construction, the swing lever 2 is vertically swung via the bifurcated part 2*a* simultaneously with the vertical movement of the needle bar 31. When the swing lever 2 assumes an upper position, the feed presser 4 is pressed downward via the transmission lever against the spring force of the spring member. Workpiece cloths W1 and W2 placed on an upper side of a needle plate 9 is vertically held between a feed dog (not shown) of a sewing bed B and the feed presser 4 thereby to be moved rearward by the feed dog. When the swing lever 2 is swung from an approximately middle position of a range of the swing movement to a lower position, the feed presser 4 is departed from the workpiece cloth W1 by the spring force of the spring member and then returned to the original feed start position by the transmission lever.

The body frame 3 has a rear end formed with a generally C-shaped attaching part 6 which is integrally formed so as to protrude rearward. The attaching part 6 has right and left side walls in which respective bearing holes 6*a* are formed so as to be opposed to each other. The quilting ruler 10 has a bar-shaped support 11 inserted through the bearing holes 6*a* so as to be non-rotational. In this case, the bar-shaped support 11 has an outer periphery including a lower flat portion 11*b* which is fitted with a linear cut part 6*b*. As a result, the bar-shaped support 11 is detachably attachable to the attaching part 6 so as to be directed in a right-left direction and so as to be substantially horizontal.

Furthermore, a shaft retaining member 7 is provided between the bearing holes 6*a* of the attaching part 6. The bar-shaped support 11 is insertable through the shaft retaining member 7 (see FIG. 1) and is capable of retaining the shaft retaining member 7. The shaft retaining member 7 is made of a resin member, for example, and has elasticity that imparts resistance of the insertion direction (the right-left direction) to the bar-shaped support 11. The bar-shaped support 11 is held by the shaft retaining member 7 so that the quilting ruler 10 is detachably attached to the walking foot 1.

Next, the quilting ruler 10 will now be described in detail. The quilting ruler 10 has the bar-shaped support 11, the cloth guide 12, the torsion coil spring 14, the cloth guide 15 and the stopper 16. The cloth guide 12 is connected to the bar-shaped support 11 and biased to the side of the workpiece cloths W1 and W2 by the torsion coil spring 14. The cloth guide 12 has a front end to which the cloth guide plate 15 is connected. The stopper 16 is provided for limiting the vertical swing of the cloth guide 12 to a predetermined range.

Referring to FIGS. 1 to 4, the bar-shaped support 11 is a linear shaft material with a predetermined length and has a right end formed with a connecting part 11*a* to which the cloth guide 12 is connected. Baselines 20 comprising a plurality of dimension lines are engraved on an almost overall upper surface of the bar-shaped support 11 so as to indicate dimensions from the cloth guide plate 15 which will be described later, for example, every 1 mm. Furthermore, the generally L-shaped stopper 16 has a short wall 16*a* secured to the right end of the bar-shaped support 11. The stopper 16 further has a long wall 16*b* which is directed leftward so as to correspond to the connecting part 11*a*.

The cloth guide 12 has a guide body 13 comprising a plate-shaped member and the cloth guide plate 15 connected to a front end of the guide body 13 as shown in FIGS. 1, 2, 4 and 5. The guide body 13 is comprised of a plate-shaped member which is elongated in the front-rear direction and has a predetermined width. The guide body 13 has a rear end having a pair of right and left first supports 13*a* formed by upwardly bending right and left sides. The guide body 13 is supported via the first supports 13*a* on the connecting part 11*a* of the bar-shaped support 11 so as to be pivotable or swingable vertically.

A retaining ring 21 such as an E-ring attached to the left end of the connecting part 11*a* of the bar-shaped support 11. As a result, the guide body 13 is positioned with respect to the right-left direction by the short wall 16*a* of the stopper 16 and the retaining ring 21. The torsion coil spring 14 is wound around the connecting part 11*a* of the bar-shaped support 11 as shown in FIGS. 1 to 4. The torsion coil spring 14 has one end locked by the long wall 16*b* of the stopper 16 and the other end locked by the guide body 13. Accordingly, the guide body 13 is biased by the torsion coil spring 14 to the side of the workpiece cloths W1 and W2 so as to be pivotable.

Figure 2:
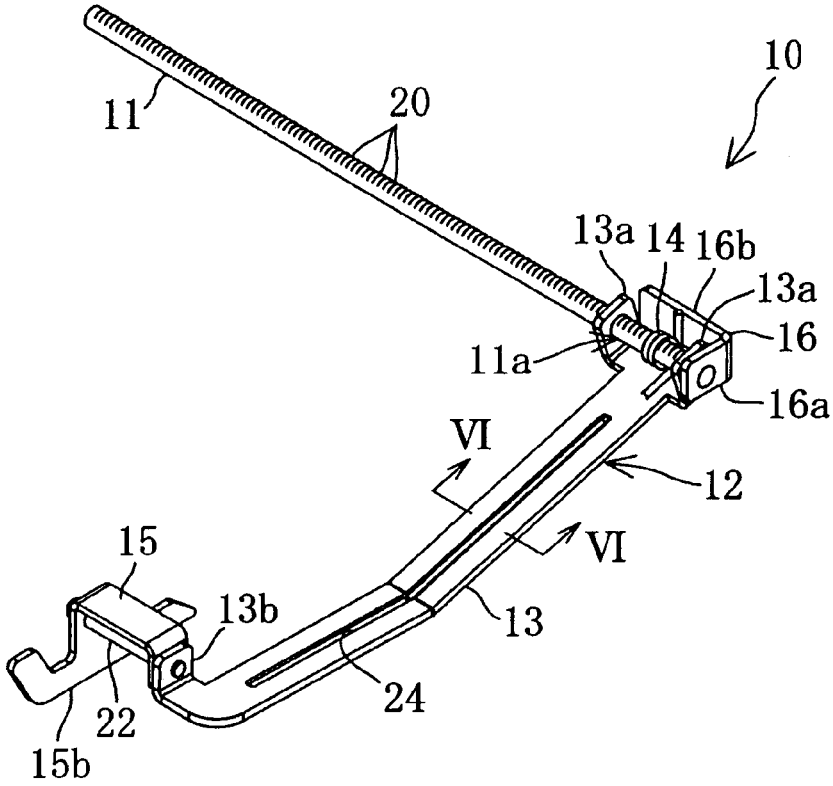
FIG. 2 is a perspective view of the quilting ruler.
Figure 3:
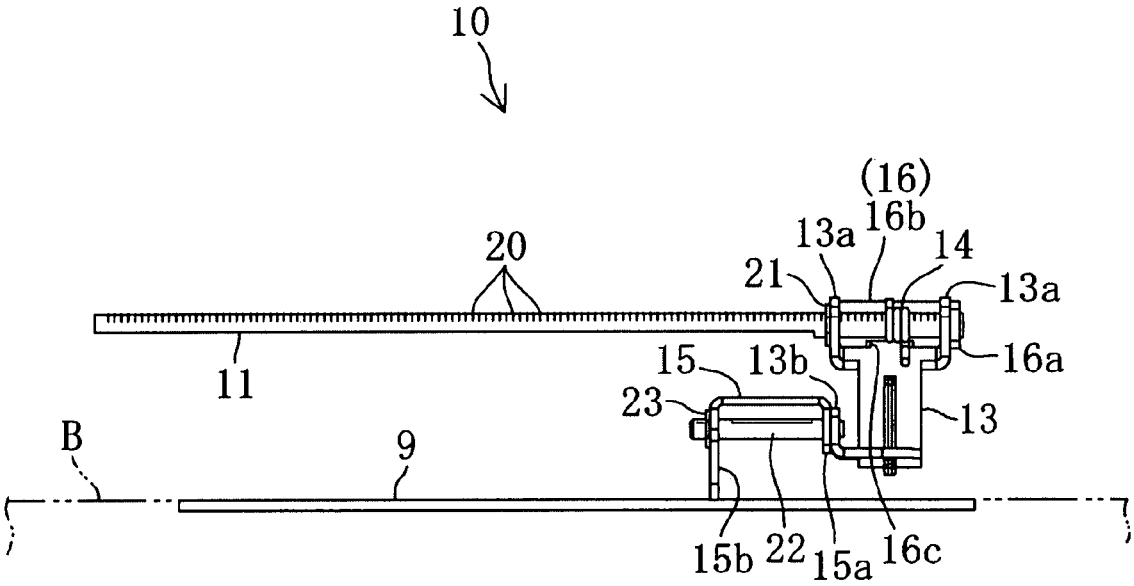
FIG. 3 is a front view of the quilting ruler.
Figure 4:
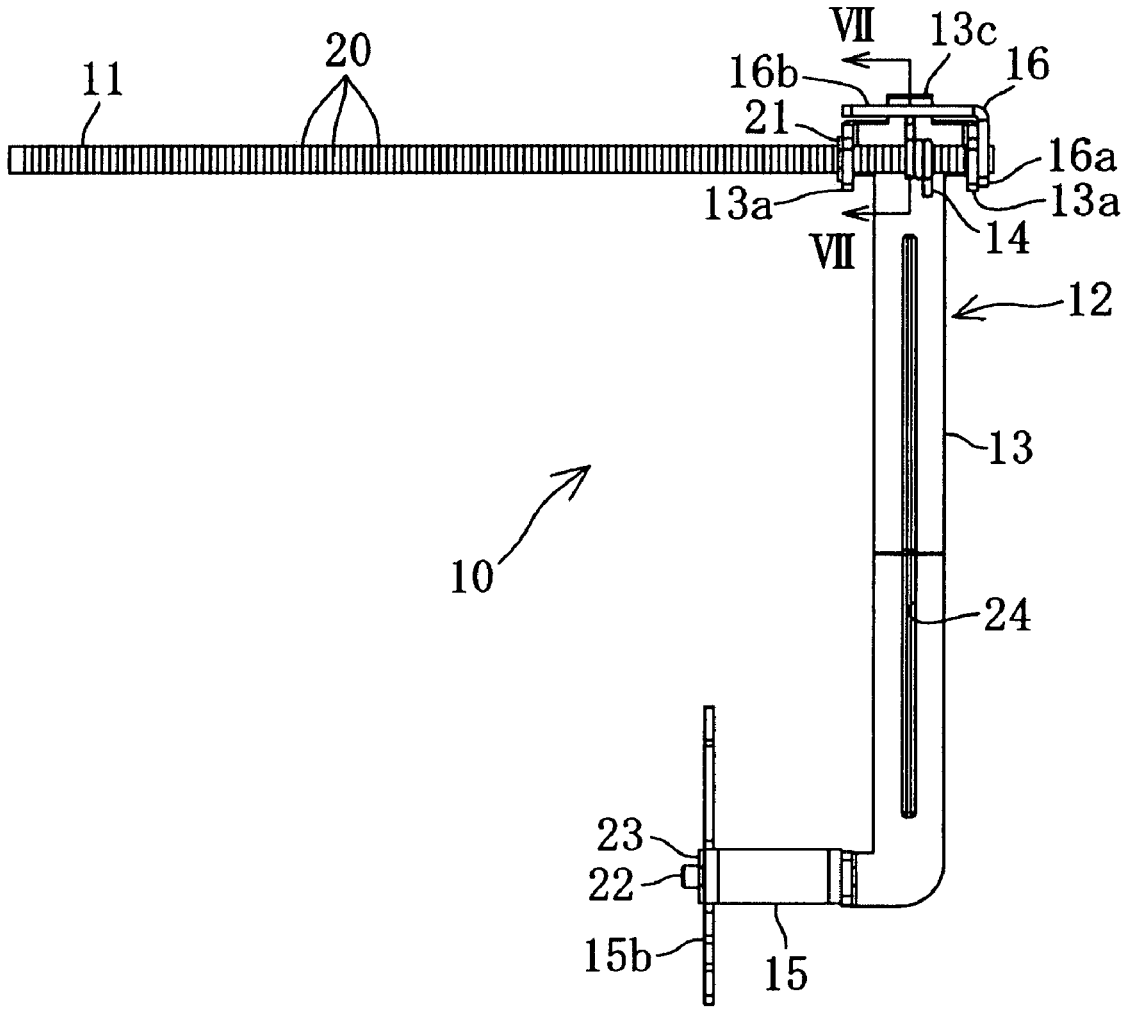
FIG. 4 is a plan view of the quilting ruler.

The guide body 13 has a substantially lengthwise middle part which is bent at a predetermined angle (about 20°, for example) into a generally angular shape. The guide body 13 further has a leftwardly bent front end which has an upwardly bent second support 13*b*. The cloth guide plate 15 is mounted via a support pin 22 directed in the right-left direction on the second support 13*b* so as to be swingable (freely rotatable). More specifically, the cloth guide plate 15 is formed into a generally portal shape and has a downwardly bent right end formed with a third support 15*a* and a downwardly bent left end formed with a cloth guiding part 15*b* as shown in FIGS. 1 to 3. The support pin 22 having a right end secured to the second support 13*b* is inserted in turn through the third support 15*a* and an upper end of the cloth guiding part 15*b*. The cloth guide plate 15 is supported by the support pin 22 so as to be swingable. A snap ring such as an E-ring is attached to a left end of the support pin 22, whereupon the cloth guide plate 15 is prevented from detaching from the support pin 22. The guide body 13 has a beaded reinforcing rib 24 (see FIG. 6) extending along substantially an overall length of the guide body 13. As a result, the guide body 13 is reinforced so as to be prevented from torsional deformation or flexural deformation, thereby having an improved stiffness.

The cloth guiding part 15*b* has an underside formed into a linear shape as shown in FIGS. 1, 2 and 5. The underside of the cloth guiding part 15*b* has a front end inclined upward, whereupon the cloth guide plate 15 can smoothly be moved along the surfaces of the workpiece cloths W1 and W2 during the sewing operation in which the workpiece cloths W1 and W2 are moved rearward.

Figure 7:
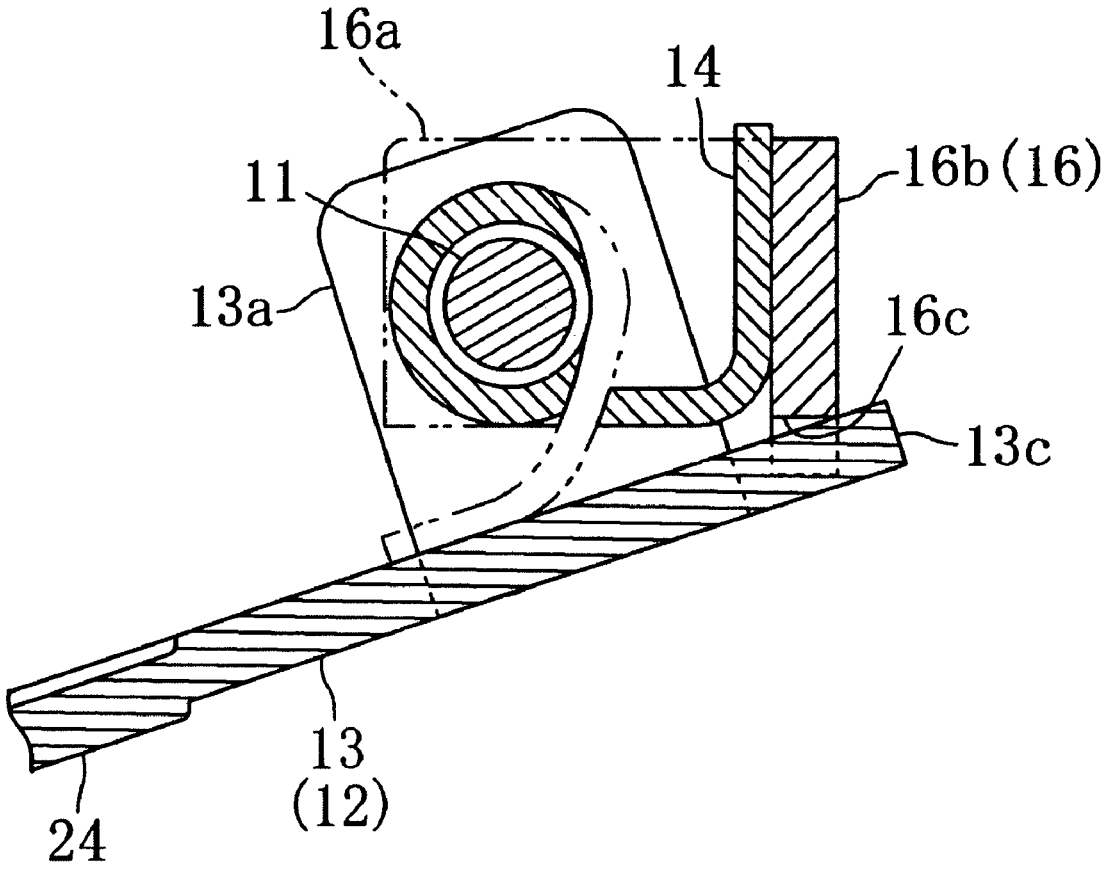
FIG. 7 is a longitudinally sectional side view taken along line VII-VII in FIG. 4.
Figure 8:
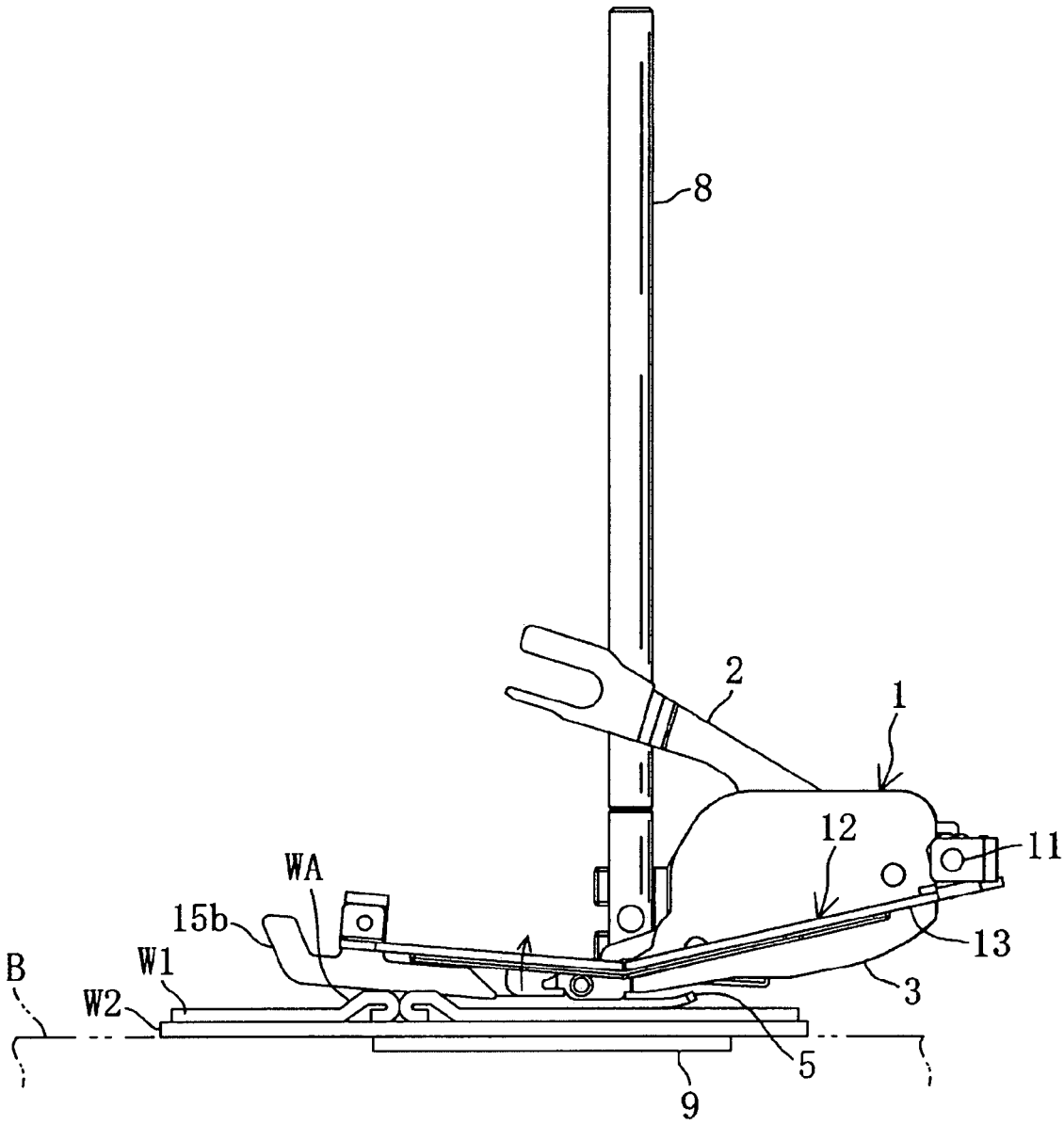
FIG. 8 is a view similar to FIG. 5, showing the condition where the quilting ruler is getting over the swollen part of the workpiece cloth.

The stopper 16 has a notch 16*c* formed in a lower end of the long wall 16*b* thereof as shown in FIG. 3. The notch 16*c* is located at a middle part of the aforesaid lower end with respect to the right-left direction and has a predetermined width. The guide body 13 has a rear end formed with a protrusion 13*c* which is to be fitted in the notch 16*c* from below. The protrusion 13*c* of the guide body 13 has an upper surface capable of abutting against the notch 16*c* of the stopper 16 as shown in FIG. 7.

The cloth guide 15*b* contacts the surfaces of the workpiece cloths W1 and W2 when the presser bar 8 assumes the lowered position and the workpiece cloths W1 and W2 are held between the cloth presser 5 and the needle plate 9. Accordingly, the upper surface of the protrusion 13*c* is disengaged from the notch 16*c* of the stopper 16 as shown in FIG. 5. In this case, the guide body 13 is biased downward by the torsion coil spring 14, whereupon the cloth guide 15*b* presses the workpiece cloth W1 and W2 by a predetermined spring force. However, when the presser bar 8 has been switched to the raised position, the protrusion 13*c* of the guide body 13 abuts against the notch 16*c* of the stopper 16 since the cloth guide 12 is biased downward by the torsion coil spring 14. The bar-shaped support 11 and the cloth guide 12 are raised in synchronization with the presser bar 8 such that a space for moving the workpiece cloths W1 and W2 onto the needle plate 9 is ensured.

The quilting ruler 10 thus constructed operates as follows. Upon start of the sewing, the operator firstly attaches the walking foot 1 to the lower end of the presser bar 8. The operator further attaches the bar-shaped support 11 of the quilting ruler 10 to the attachment part 6 of the walking foot 1. The operator places two workpiece cloths W1 and W2 on the needle plate 9 in an overlapped state as shown in FIG. 5. The base line 20 is caused to correspond with the right-end position of the attaching part 6. When the cloth presser lever (not shown) is operated so as to be lowered, the presser bar 8 is lowered, and the walking foot 1 and the quilting ruler 10 are lowered together so as to be located on the workpiece cloths W1 and W2. In this case, the spring force of the torsion coil spring 14 causes the cloth guide plate 15 to press the surface of the workpiece cloth W1 downward. When only the preceding cloth guide plate 15 passes a protuberant part WA caused by folding back the workpiece cloth W1, the cloth guide 15*b* runs on the protuberant part WA against the spring force of the torsion coil spring 14. After the cloth guide 15*b* has passed the protuberant part WA, the spring force of the torsion coil spring 14 lowers the cloth guide 15*b* to the surface of the workpiece cloth W1. The cloth guide 15*b* continuously moves while following the surface of the workpiece cloth W1.

Thus, the quilting ruler 10 is detachably attached to the attaching part 6 of the walking foot 1 further attached to the lower end of the presser bar 8. Since the bar-shaped support 11, the connecting part 11*a*, the cloth guide 12 and the torsion coil spring 14 are provided on the quilting ruler 10, the cloth guide 12 is temporarily swung upward when the protuberant part WA of the workpiece cloth W1 is sewn. However, after having passed the protuberant part WA, the cloth guide 12 is swung downward thereby to return to the original position, continuously following the surface of the workpiece cloth W1. Consequently, the operator need not to lower the cloth guide 12 manually to the cloth surface every time the cloth guide 12 passes the protuberant part WA. The working efficiency of the sewing work can be improved greatly.

Furthermore, the cloth guide 12 is supported on the bar-shaped support 11 so as to be swingable vertically. The torsion coil spring 14 is provided for biasing the cloth guide 12 so that the cloth guide 12 is caused to pivot. Consequently, the quilting guide 10 can be rendered smaller in size and light-weighted and can be simplified in the construction, and moreover, the production costs can be reduced.

The torsion coil spring 14 is provided about the connecting part 11*a* of the bar-shaped support 11 to bias the cloth guide 12. As the result of provision of the torsion coil spring 14, the spring rate serving to bias the cloth guide 12 can be reduced. Accordingly, even when changes in the thickness of cloth vary an amount of flexure of the spring to a large degree, variations in the spring force can be rendered smaller. Consequently, the cloth guide 12 can smoothly pass along the corrugated surface of the quilting cloth or the like. Moreover, a work for assembling the quilting ruler 10 can be simplified.

The bar-shaped support 11 has the stopper 16 limiting the vertical swing of the cloth guide 12 to the predetermined range. Accordingly, when within the range of vertical swing during sewing, the cloth guide 12 smoothly passes along the protuberant part WA of the surface of the workpiece cloth W1. Moreover, when the walking foot 1 is raised to the raised position upon completion of the sewing, the stopper 16 locates the cloth guide 12 at the lowermost end within the vertical swing range. In this case, the cloth guide 12 does not press the workpiece cloth W1. Accordingly, the cloth guide 12 does not prevent movement of the workpiece cloth W1 when the workpiece cloth W1 is set or taken out, whereupon the workpiece cloth W1 can smoothly be moved.

The cloth guide 12 comprises the guide body 13 which is directed in the front-back direction and has the rear end provided with the paired first supports 13*a* and the cloth guide plate 15 which is connected to the front end of the guide body 13 so as to be directed in the front-back direction. The cloth guide plate 15 is mounted on the guide body 13 so as to be swingable. Accordingly, the cloth guide plate 15 is vertically swingable via the cloth guide 15*a*, following the protuberant part of the surface of the workpiece cloth W1. Consequently, the cloth guide plate 15 can smoothly pass along the protuberant part of while providing a gauging function. Furthermore, the guide body 13 has the reinforcing rib 24 extending along substantially the overall length thereof so as to be in parallel to the lengthwise direction. As a result, the stiffness of the guide body 13 can be increased against the torsional or flexural deformation when the guide body 13 is subjected to an unexpected external force.

Since the cloth guide 12 (the guide body 13) comprises a plate-shaped member, the vertical dimension of the cloth guide 12 can be reduced. Consequently, the needle bar connecting stud 32 can be prevented from colliding with the cloth guide 12 when the needle bar 31 is vertically moved, as shown in FIG. 9.

Figure 11:
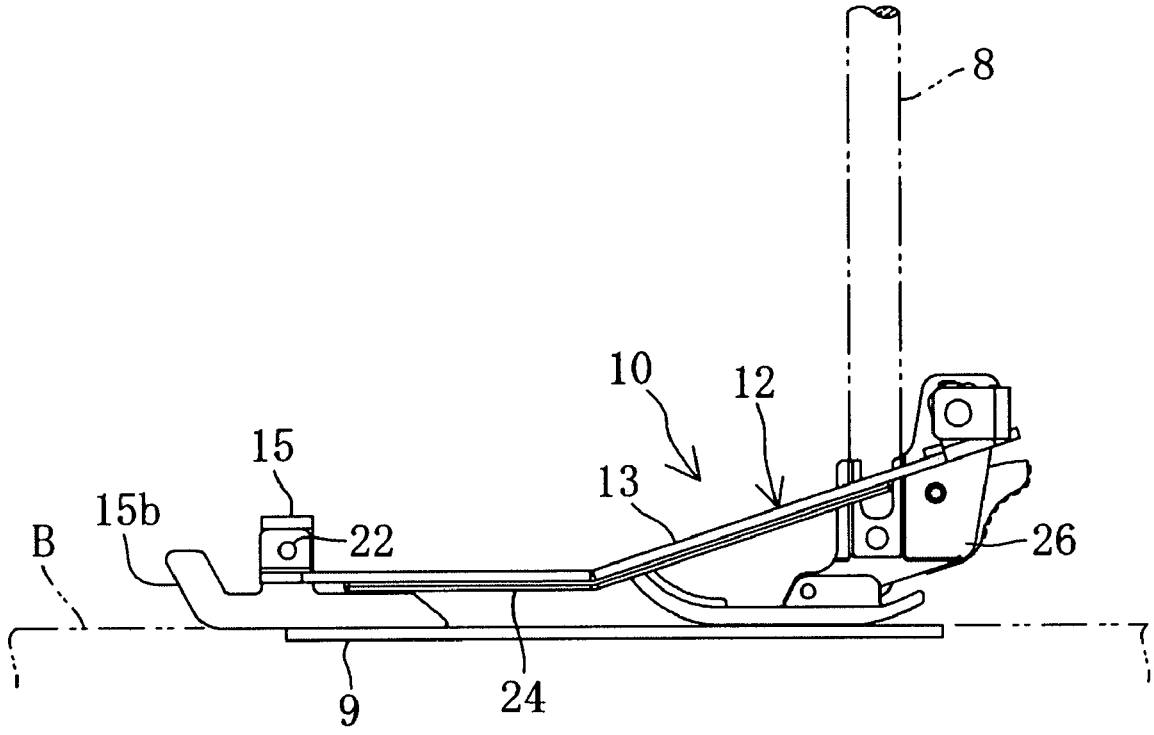
FIG. 11 is a side view of the quilting ruler of a second illustrative example of the present disclosure, the quilting ruler having been attached to the cloth presser holder.

Modified forms of the foregoing embodiment will now be described. Firstly, as shown in FIG. 11, the quilting ruler 10 may be attached to an attaching part of the rear end of the normal cloth presser holder 26. In this construction, the quilting ruler 10 can be used even when a normal workpiece cloth is sewn, instead of the quilting cloth. Furthermore, the guide body 13 may be flanged by bending the right or left end thereof in the lengthwise direction, instead of the reinforcing rib 24 formed on the guide body 13, so that the guide body 13 increases stiffness against the torsional or flexure deformation. Additionally, the guide body 13 may be comprised of a flat plate without bending a middle part thereof.

A compression coil spring or a tension coil spring may be used instead of the torsion coil spring 14. In this case, the compression coil spring or the tension coil spring may be engaged with the guide body 13 and the stopper 16.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A workpiece cloth ruler which is detachably attachable to an attaching part of a cloth presser holder or a walking foot to which a cloth presser is attached to press workpiece cloth, the ruler comprising:

a bar-shaped support detachably attachable to the attaching part of the cloth presser holder so as to be directed in a right-left direction and so as to be substantially horizontal, the bar-shaped support having an end;

a connecting part provided on the end of the bar-shaped support;

a cloth guide which is pivotally non-releasably attached via a supporting part to the connecting part of the bar-shaped support so as to be vertically pivotable; and an elastic member biasing the cloth guide to the workpiece cloth side so that the cloth guide pivots.

2. The workpiece cloth ruler according to claim 1, wherein the cloth guide includes a plate-shaped member.

3. The workpiece cloth ruler according to claim 1, wherein the elastic member comprises a torsion coil spring.

4. The workpiece cloth ruler according to claim 2, wherein the bar-shaped support has a stopper limiting the vertical pivoting to a predetermined range.

5. The workpiece cloth ruler according to claim 3, wherein the bar-shaped support has a stopper limiting the vertical pivoting to a predetermined range.

6. The workpiece cloth ruler according to claim 2, wherein the cloth guide includes a guide body having a rear end provided with the support in a front-back direction, the guide body having a front end, and a cloth guide plate coupled to the front end of the guide body so as to be directed in a front-back direction, the cloth guide plate being supported by the guide plate so as to be pivotable.

7. The workpiece cloth ruler according to claim 6, wherein the guide body has a reinforcing rib formed substantially on an overall length thereof so as to extend in parallel to a lengthwise direction.

8. A sewing machine provided with a workpiece cloth ruler which is detachably attachable to an attaching part of a cloth presser holder or a walking foot to which a cloth presser is attached to press the workpiece cloth, the ruler comprising:

a bar-shaped support detachably attachable to the attaching part of the cloth presser holder so as to be directed in a right-left direction and so as to be substantially horizontal, the bar-shaped support having an end;

a connecting part provided on the end of the bar-shaped support;

a cloth guide which is pivotally non-releasably attached via a supporting part to the connecting part of the bar-shaped support so as to be vertically pivotable; and an elastic member biasing the cloth guide to the workpiece cloth side so that the cloth guide pivots.

* * * * *